US006543367B1

(12) United States Patent
Stecker et al.

(10) Patent No.: US 6,543,367 B1
(45) Date of Patent: Apr. 8, 2003

(54) LIGHTWEIGHT TRUCK SIDEFRAME

(75) Inventors: Todd W. Stecker, Canal Winchester, OH (US); Richard B. Polley, Gahanna, OH (US); Roger D. Boster, II, Blacklick, OH (US)

(73) Assignee: Buckeye Steel Castings Company, Columbus, OH (US)

( * ) Notice: Subject to any disclaimer, the term of this patent is extended or adjusted under 35 U.S.C. 154(b) by 0 days.

(21) Appl. No.: 09/712,772

(22) Filed: Nov. 14, 2000

(Under 37 CFR 1.47)

(51) Int. Cl.[7] ..... B61F 3/00
(52) U.S. Cl. ..... 105/206.1
(58) Field of Search ..... 105/206.1, 206.2

(56) References Cited

U.S. PATENT DOCUMENTS 2,012,949 A * 9/1935 Drenning ..... 105/206.1
2,297,748 A * 10/1942 Cottrell ..... 105/206.1
5,305,694 A 4/1994 Wronkiewicz et al.
5,410,968 A * 5/1995 Hawthorne et al. ..... 105/206.1
5,481,986 A * 1/1996 Spencer et al. ..... 105/206.1
5,752,564 A 5/1998 Callahan et al.

* cited by examiner

*Primary Examiner*—S. Joseph Morano
*Assistant Examiner*—Robert J. McCarry, Jr.
(74) *Attorney, Agent, or Firm*—Banner Witcoff, Ltd.

(57) ABSTRACT

There is disclosed a lightweight truck sideframe for use in a railway car. The truck sideframe is of lighter weight than conventional truck sideframes because of the removal of the double wall of the truck sideframe tension member, leaving a single wall tension member. Removal of this significant mass of metal requires reinforcement of the truck sideframe in several areas including in the tension member below the spring seat, in the compression member, and at the side wall window. The resulting truck sideframe construction is of lighter weight than conventional truck sideframes and exceeds the Association of American Railroad's requirements for strength and durability.

11 Claims, 6 Drawing Sheets

LIGHTWEIGHT TRUCK SIDEFRAME

BACKGROUND OF THE INVENTION

1. Field of the Invention

The present invention relates in general to improved truck sideframes for railway cars. More specifically, but without restriction to the particular use which is shown and described, this invention relates to a lighter weight truck sideframe.

2. Description of the Related Art

As conventional, railcar trucks are the wheeled vehicles that ride on the tracks and support the railcar body. Each truck includes wheel sets which include two wheels spaced transversely from each other and joined by a transversely extending axle. Transversely spaced truck sideframes are supported on the wheel sets. The truck sideframes are longitudinally elongated and define longitudinally spaced, downwardly opening pedestal jaws which are mounted on the journal bearings of the wheel sets. Transversely extending between each truck sideframe is a bolster on which is mounted the car body.

The Association of American Railroads ("A.A.R.") sets forth structural requirements for the various components of the trucks, including the truck sideframes. The requirements for the truck sideframe include specific strength and fatigue resistant capabilities for extended service of the truck sideframe. Because the railcar truck sideframes must exhibit high strength, truck sideframes are conventionally made of cast steel, which contributes a significant part of the total weight of the railway car. In the rail line shipping industry, weight limits are placed on shippers of goods for preserving the safety and conditions of the track. Consequently, the quantity of goods that may be carried by a railcar is affected by the total weight of the railcar body, the trucks and accompanying railcar components, such as the truck sideframe. Accordingly, a reduction in the weight of the railcars, including the truck sideframes, will result in an increase in the total capacity of goods shipped by a rail line owner. Therefore, it is highly desirable to reduce the weight of the truck sideframe while maintaining the strength and fatigue resistance capabilities of the sideframe, as required by the A.A.R.

SUMMARY OF THE INVENTION

Accordingly, an object of the present invention is to reduce the overall weight of a railway car by reducing the weight of the truck sideframe. It is another object of the invention to reduce the weight of the truck sideframe without a decrease in strength or durability. Yet another object of the invention is to minimize core seams and core shifting by reducing the number of cores used. Still another object of the present invention is to minimize chaplets in the drag by setting the core in the mold on its prints.

Briefly stated, the present invention involves lightening the truck sideframe by removing the double wall of the truck sideframe tension member. Removing this significant mass of metal requires reinforcement of the truck sideframe in the following areas: 1) extending the rib under the spring seat out to the column wear plate wall; 2) increasing the thickness under the radius at the spring seat in the side wall; 3) increasing the width of the truck sideframe at its centerline; 4) increasing the depth of the truck sideframe at its centerline; 5) locally sloping the top compression member toward the side walls and locally increasing the interior radius between the sloped top compression member and each side wall to prevent the top compression member from buckling; and 6) splitting the side window with a reinforcing rib, the reinforcing rib defining a raised portion to prevent the sidewall from buckling. Significantly, with these truck sideframe modifications, the resulting truck sideframe construction is of lighter weight than conventional truck sideframes and exceeds the A.A.R. requirements for strength and durability.

The full range of objects, aspects and advantages of the invention are only appreciated by a full reading of this specification and a full understanding of the invention. Therefore, to complete this specification, a detailed description of the invention follows, after a brief description of the drawings.

BRIEF DESCRIPTION OF THE DRAWINGS

The embodiments of the invention will be described in relation to the accompanying drawings. In the drawings, the following figures have the following general nature.

In the accompanying drawings, like reference numerals are used throughout the various figures for identical structures.

DESCRIPTION OF THE INVENTION

Figure 1:
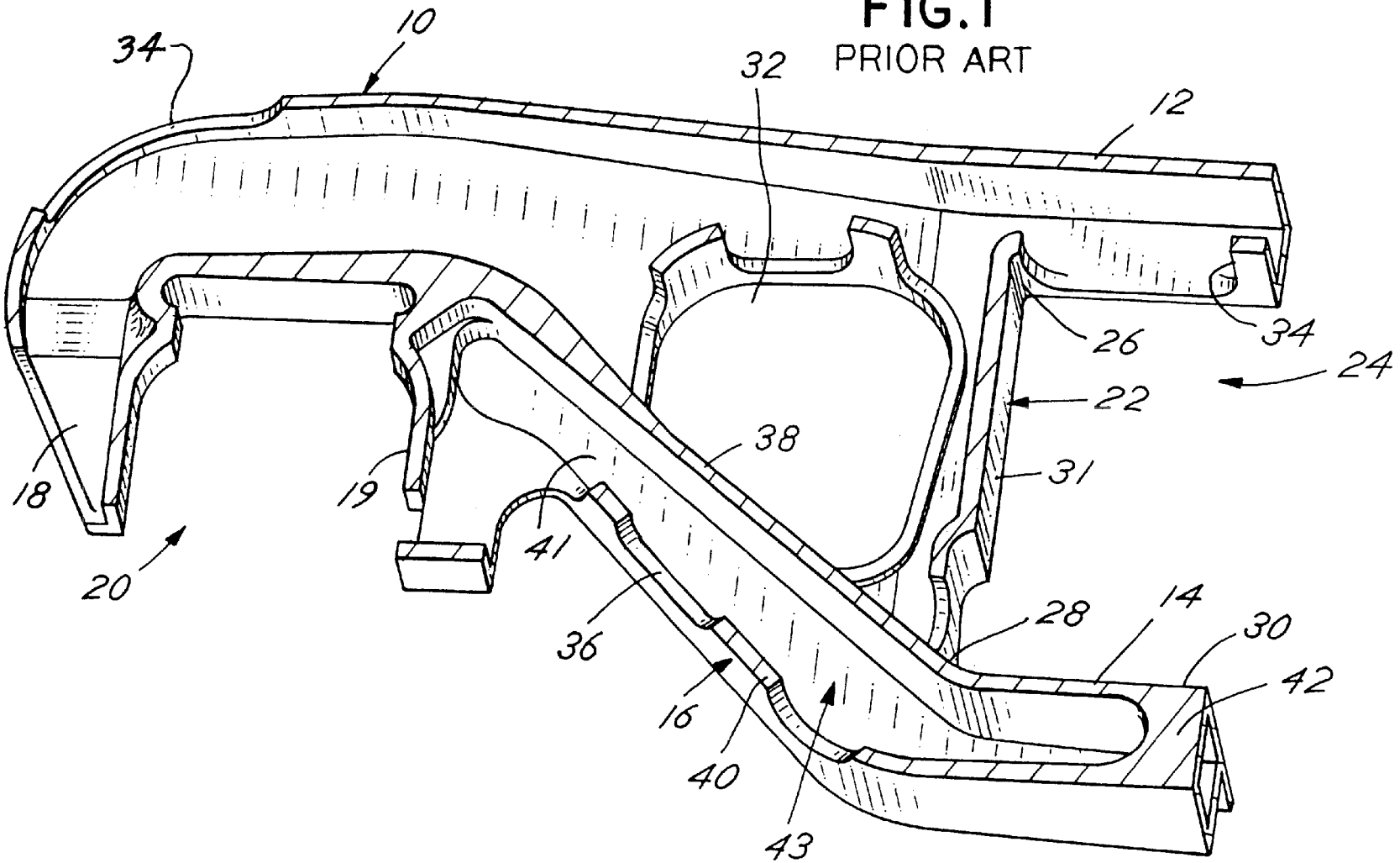
FIG. 1 PRIOR ART
FIG. 1 is a cross-section view of a prior art truck sideframe.
Figure 2:
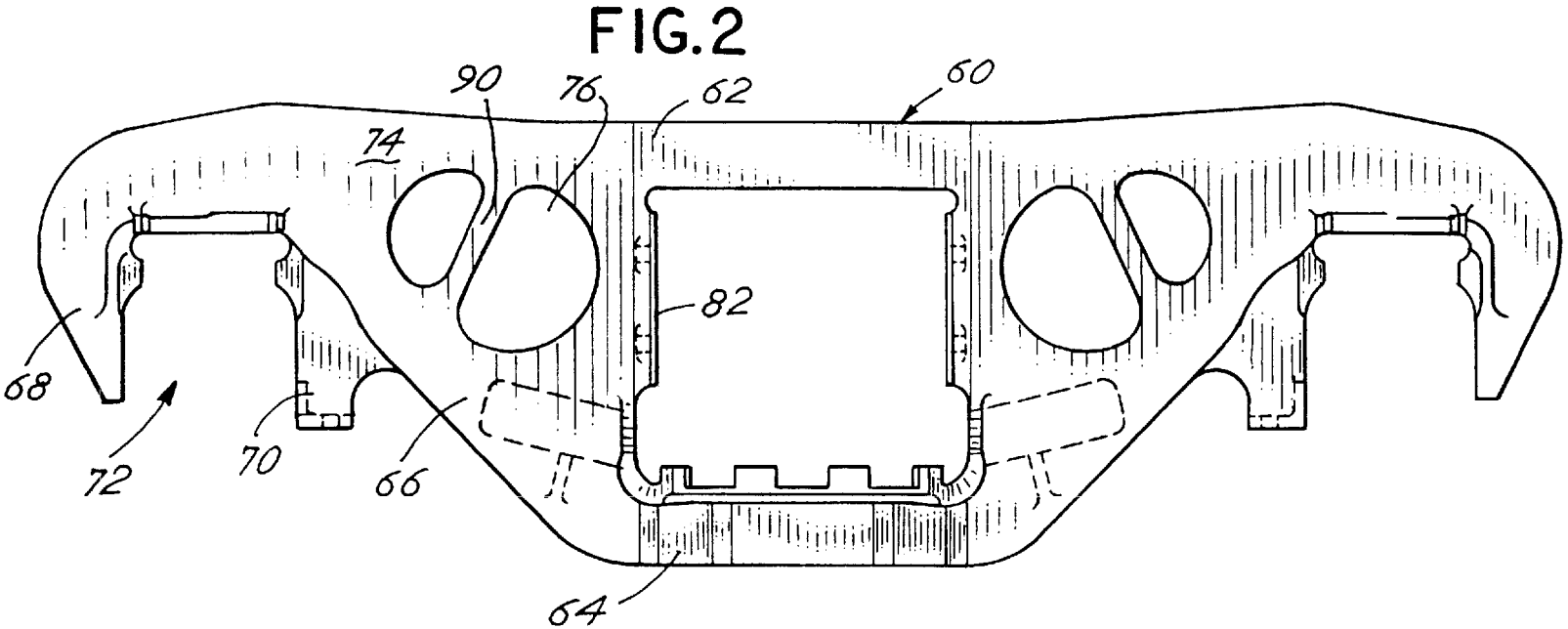
FIG. 2 is a side view of the truck sideframe of the present invention.
Figure 3:
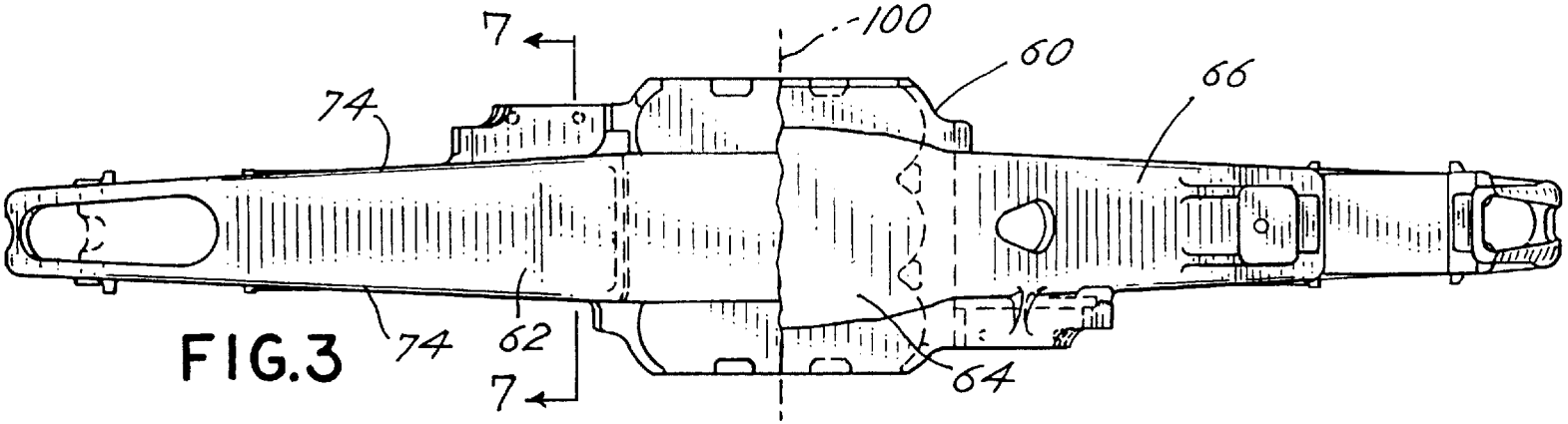
FIG. 3 is a half top view and a half bottom view of the truck sideframe of FIG. 2.
Figure 4:
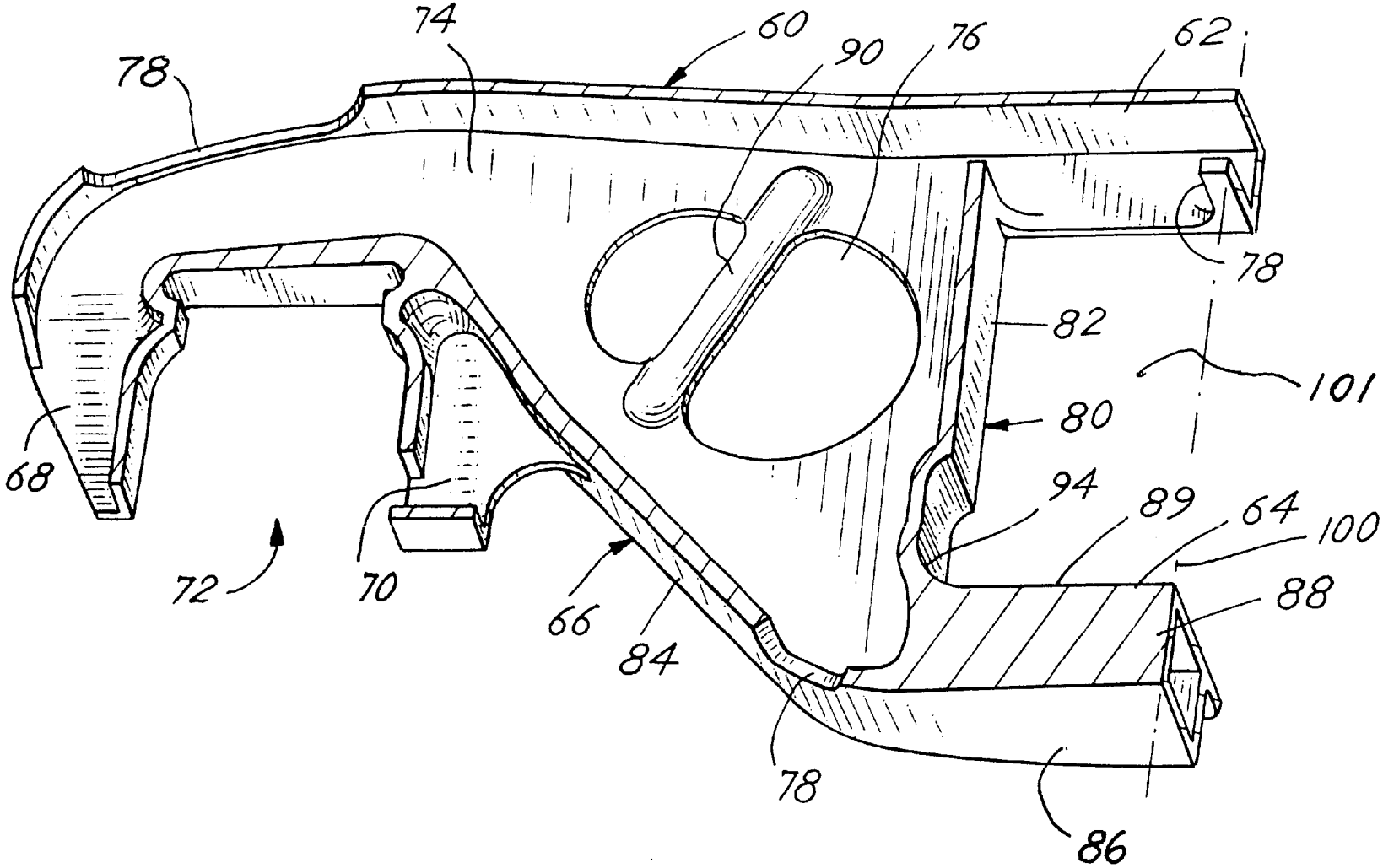
FIG. 4 is an isometric partial view of the truck sideframe of FIG. 2.
Figure 5:
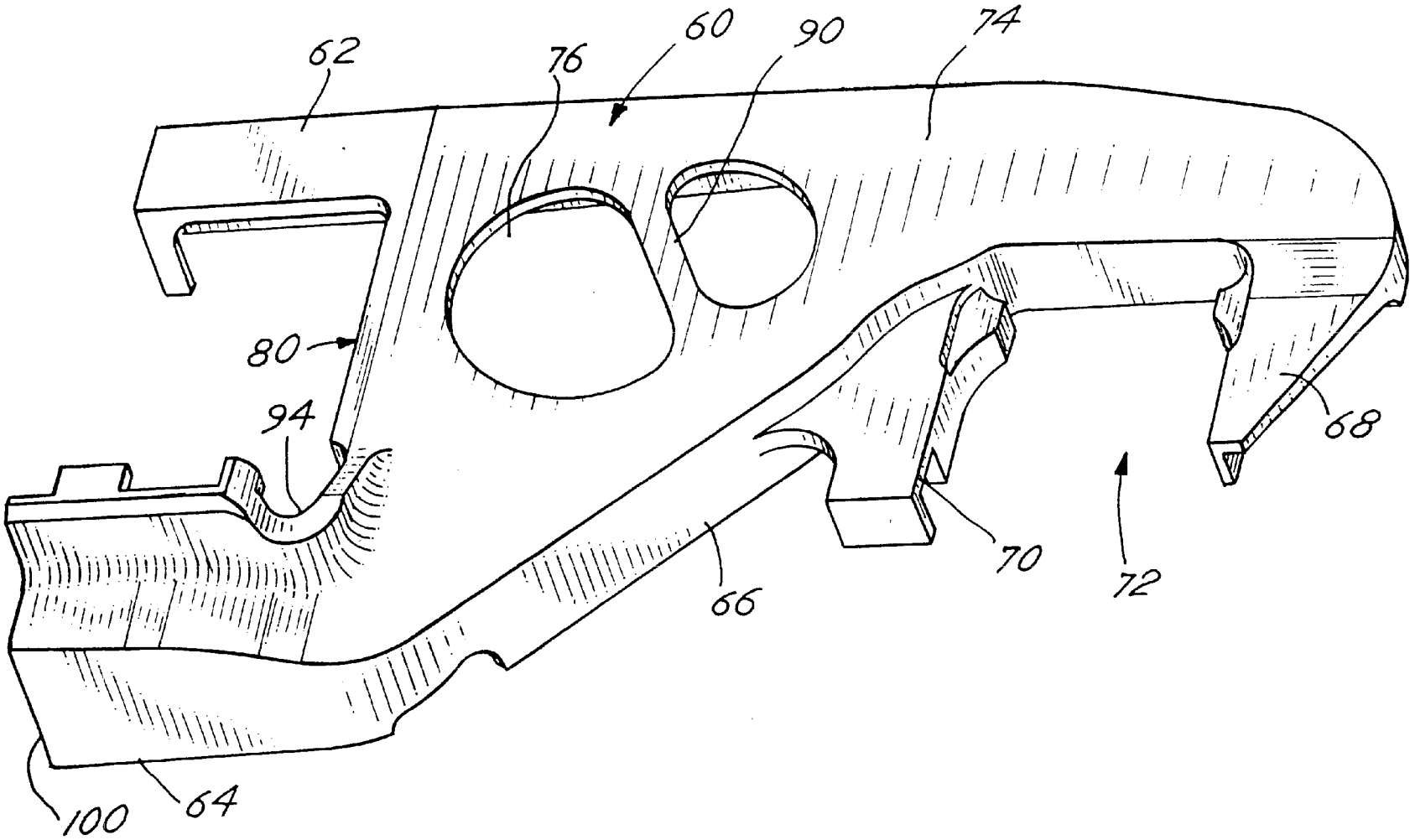
FIG. 5 is an isometric partial view of the truck sideframe of FIG. 2.

Referring to FIG. 1, there is shown a cast railway truck sideframe 10 common to the railroad industry. For a better understanding of the present invention, the prior art truck sideframe 10 will first be described followed by the inventive truck sideframe and the structural differences and weight savings gained by the improved truck sideframe. The conventional truck sideframe 10, as illustrated in partial cut-out view in FIG. 1, defines a top compression member 12 extending along the longitudinal length of the sideframe, and a lower tension member 14 generally parallel to the compression member 12. The lower tension member 14 includes a diagonally extending double-wall arm 16 which extends to downwardly extending pedestal jaws 18 and 19. The pedestal jaws define the axle-accommodating pedestal opening 20 wherein the bearing adapters (not shown) of the railcar wheels are mounted.

It is also conventional that a vertical rib 22 extends between the tension and compression members. The vertical ribs of the truck sideframe define the truck bolster opening 24 through which is mounted the truck bolster (not shown). The vertical ribs are joined to the tension and compression members at the bend points 26, 28. The wall of the tension member at these bend points 26, 28 typically has a uniform thickness, the significance of which is discussed below. The vertical rib further defines a wear plate area 31. Formed between the vertical ribs of the truck sideframe along the tension member is the bolster spring seat 30 on which is mounted the bolster springs (not shown). As previously stated, the truck bolster is mounted between the truck sideframes, extending through the bolster opening 24. The truck bolster is supported by the bolster springs which are mounted on the bolster spring seat 30. Located along the side walls of the truck sideframe bounded by the compression and tension members and the vertical ribs are lightener holes 32 which provide weight savings for the truck sideframe and access to the brake shoes (not shown). Other weight saving lightener holes 34, 36 are located on the truck sideframe in the compression member and tension member, respectively.

As depicted in FIG. 1, the known truck sideframe includes a tension member that defines two tension walls 38, 40 which extend the entire length of the tension member, forming the diagonally extending double-wall arm 16. The cross-sectional thickness of the tension walls 38, 40 vary depending on the rated railcar truck tonnage. The tension walls, and side walls 41 in the tension member define a tension core 43. The core 43 extends the entire length of the tension member including the diagonal arms 16. The double tension wall, while providing structural integrity to the truck sideframe, adds significantly to the overall weight of the truck sideframe. As discussed below, the present invention eliminates the double tension wall to reduce the overall weight of the truck sideframe while maintaining the structural integrity of the sideframe. Located between and connecting the tension walls 38, 40 is a vertical spring seat support rib 42. The support rib 42 is located directly below the spring seat 30 at the centerline of the truck sideframe to add structural support and strength to the tension member.

Referring to FIGS. 2–8, there is disclosed an exemplary embodiment of the truck sideframe 60 of the present invention. As with conventional truck sideframes, the truck sideframe 60 defines an upper compression member 62, and a lower tension member 64 defining diagonally extending support arms 66. The support arms 66 and compression member terminate to form downwardly extending pedestal jaws 68, 70. The pedestal jaws define the axle-accommodating pedestal opening 72 wherein the bearing adapters (not shown) of the railcar wheels are mounted. The truck sideframe 60 defines side walls 74 and lightener holes 76 in the side walls. Other lightener holes 78 are located in the compression and tension members. Located and extending between the compression and tension members are vertical ribs 80 which further define bolster wear plates 82.

Figure 6:
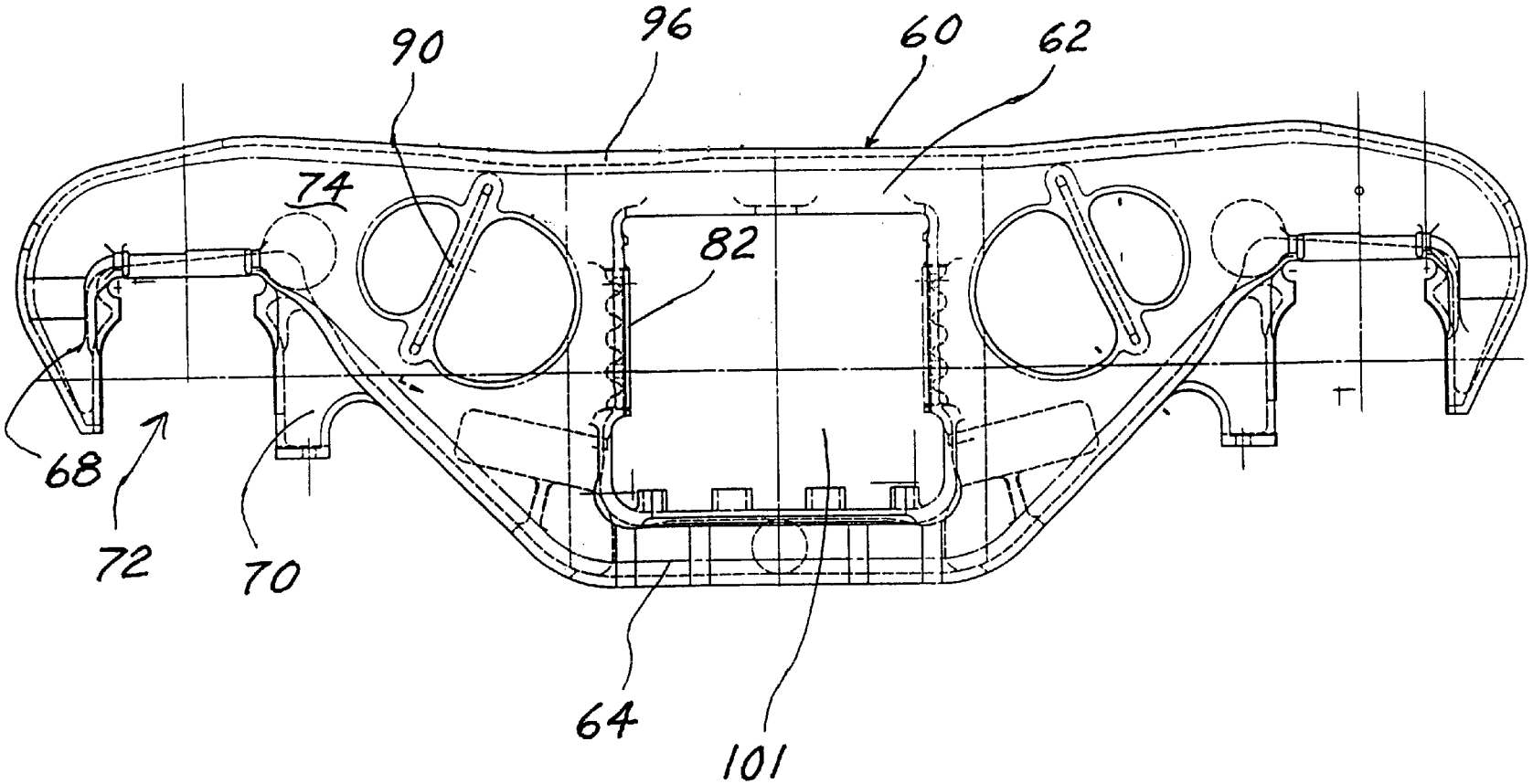
FIG. 6 is a cross-section side view of the truck sideframe of FIG. 2.
Figure 7:
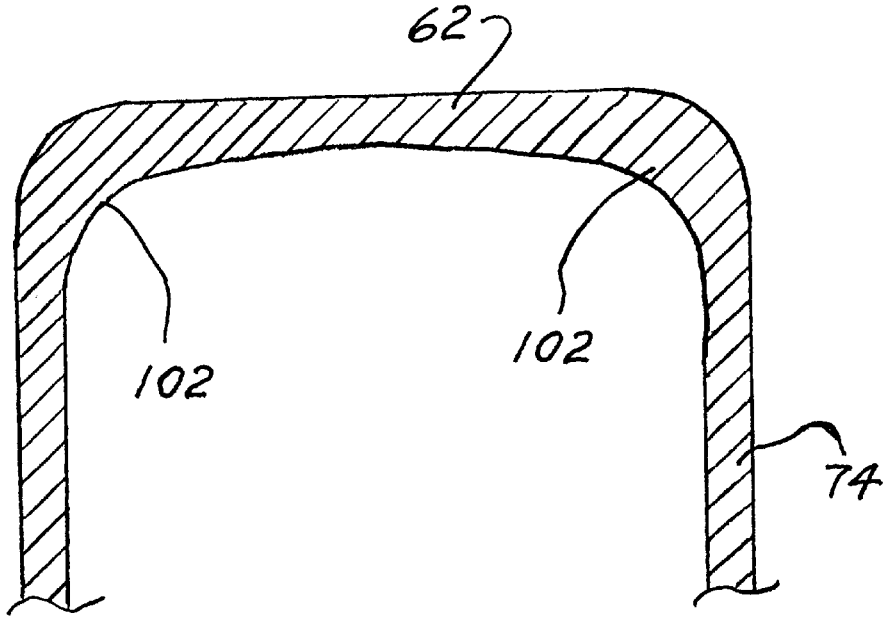
FIG. 7 is a cross-section view of the top compression member of the truck sideframe of FIG. 3 taken at line 7—7.

As previously stated, the subject matter of the present invention is directed to reducing the overall weight of the truck sideframe through various structural changes to the sideframe. Specifically, the most significant structural change from the conventional truck sideframe is the removal of the double wall in the tension member, replacing it with a single tension member construction. As exemplified in FIG. 4, a single tension wall 84 extends from the bottom wall 86 of the compression member below the spring seat 89 to the pedestal jaw 70. That is, the diagonally extending support arms 66 are a single wall construction. To maintain the structural strength of the truck sideframe, additional structural changes are made to the conventional truck sideframe including extending the rib 88, which is located under the bolster spring seat 89, the entire length of the spring seat. In other words, the rib 88 is extended from a point directly below one of the vertical ribs to a point directly below the other vertical rib. In addition, a reinforcing rib 90 is located along the side walls 74 at the lightener hole 76 splitting the lightener hole into two lightener holes. The reinforcing rib is located diagonally across the lightener hole and defines a parabolic cross-section with the maximum material thickness at the middle of the rib. The reinforcing rib 88 prevents the side walls 74 from buckling under a loaded condition. Still further structural changes of the present invention include increasing the wall thickness of the truck sideframe at various locations. The thickness of the side wall 74 is increased near the radius 94 where the vertical rib 80 joins with the bolster spring seat plate 89. In addition, the thickness of the spring seat plate 89 is increased at the radius 94. Further, material is added at centerline 100 of the truck sideframe increasing the width and depth of the sideframe at the centerline. To prevent local buckling of the top compression member 62, the compression member is locally reinforced at 96 outboard of the bolster opening 101, as shown in FIG. 6, by sloping the top compression member 62 toward the side walls 74 and increasing the interior radii 102 between the top compression member and the side walls, as depicted in FIG. 7. The increase in the radii 102 results in the wall thickness of the sideframe at the radii 102 being greater than the wall thickness of the adjoining compression member 62 and side walls 74.

The aforementioned structural changes maintain the structural integrity of the truck sideframe while decreasing the overall weight of the sideframe. It will be understood by one skilled in the art that variations of the illustrated truck sideframe are possible without being outside the scope of the present invention. Except for the above mentioned features of the present invention, the remaining features of the truck sideframe 60 are conventional.

Significantly, the removal of the second tension wall reduces the number of casting cores. With a fewer number of cores, problems encountered during the pouring process, such as, core shifting, which leads to casting flaws, offsets and dimensional inconsistencies are reduced. In addition, stress concentrations which develop at these casting flaws and offsets and which are a primary reason for metal fatigue, are also reduced. With fewer cores, manufacturing is improved, resulting in an increase in production efficiency. Furthermore, with the core arrangement of the present invention, fewer chaplets are needed to support the core. Instead, the mold supports the core minimizing problems such as stress concentrations around the chaplets and chaplet scars or lack of fusion of the chaplets to the casting. Still further, finishing of the chaplet scars is reduced by minimizing the number of chaplets.

Figure 8:
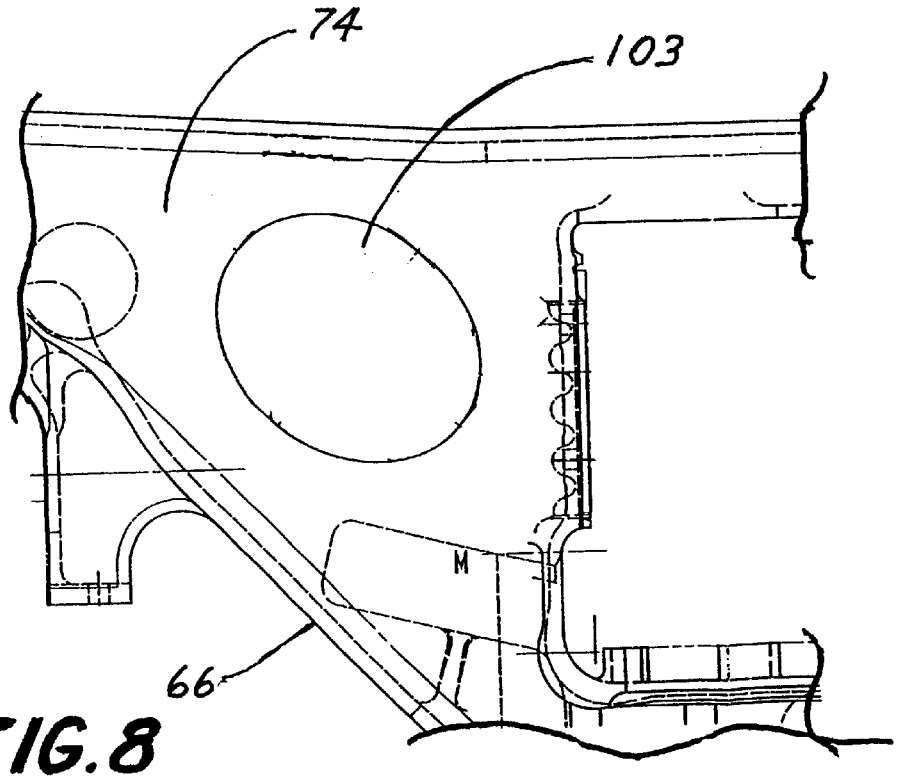
FIG. 8 is a partial side view of an alternative embodiment of the present invention.

Referring to FIG. 8, there is disclosed an alternative embodiment of the present invention. As depicted, this embodiment illustrates the removal of the reinforcing rib 90 and the use of a lightener hole 103 in the side walls 74. In this arrangement, the lightener hole 103 is elliptically shaped and aligned at approximately the same angle as the diagonally extending support arms 66. The remaining construction of the embodiment depicted in FIG. 8 is the same as the embodiment depicted in FIG. 2.

It will be understood by one skilled in the art that variations to the present invention are possible without being outside the scope of the invention. Therefore, to particularly point out and distinctly claim the subject matter regarded as the invention, the following claims conclude the specification.

What is claimed is:

1. A cast truck sideframe comprising:

an upper compression member, a lower tension member joined to the compression member by vertical ribs extending from the tension member to the compression member, a pair of opposing side walls joined to the compression member, the junctures between the vertical ribs and the tension member being locally reinforced by increasing the thickness of the sidewalls near the juncture, the lower tension member defining opposing ends, a pair of downwardly extending pedestal jaws located at the opposing ends of the tension member, a pair of diagonally extending support arms extending from the tension member to the pedestal jaws, and a radius defining the juncture between the compression member and each side wall, each side wall defining a lightener hole located in the side wall, the lightener hole having a support rib extending across the lightener hole.

2. The cast truck sideframe of claim 1 wherein the support rib has a parabolic cross-section.

3. The cast truck sideframe of claim 1 wherein the tension member defines a support rib extending between the vertical ribs.

4. The cast truck sideframe of claim 1 wherein the tension member has a width that is greater than the width of the support arms.

5. The cast truck frame of claim 1 wherein the compression member is locally reinforced by sloping of the compression member toward the side walls and increasing the radius between the compression member and each side wall.

6. A cast truck sideframe comprising:

an upper compression member, a lower tension member joined to the compression member by vertical ribs extending from the tension member to the compression member, the lower tension member having diagonally extending support arms and defining opposing ends, a pair of downwardly extending pedestal jaws located at the opposing ends of the tension member, and a pair of opposing side walls joining the compression member, each side wall defining a lightener hole located in the side wall, the compression member is locally reinforced by sloping the compression member toward the side walls.

7. The cast truck sideframe of claim 6 wherein the tension member has a width that is greater than the width of the support arms.

8. A cast truck sideframe comprising:

an upper compression member, a lower tension member joined to the compression member by vertical ribs extending from the tension member to the compression member, the lower tension member defining opposing ends, a pair of downwardly extending pedestal jaws located at the opposing ends of the tension member, and a pair of opposing side walls joined with the compression member, a radius located at the juncture of the sidewalls to the compression member, the radius defining a wall thickness that is greater than the thickness of the sidewalls and the compression member in the region above the vertical ribs, the compression member being locally reinforced by sloping the compression member toward the side walls.

9. The cast truck sideframe of claim 8 wherein each side wall defines an elliptical lightener hole located in the side wall.

10. The cast truck sideframe of claim 8 wherein the tension member has a width that is greater than the width of the support arms.

11. The cast truck sideframe of claim 9 wherein the elliptical lightener hole is aligned diagonally in the same direction as the diagonally extending support arm.

* * * * *